US011686546B1

(12) United States Patent
Dadisho et al.

(10) Patent No.: US 11,686,546 B1
(45) Date of Patent: Jun. 27, 2023

(54) FIREARM LOCKING SYSTEM

(71) Applicant: Safety Arms Systems, Wildomar, CA (US)

(72) Inventors: Edmond W. Dadisho, Wildomar, CA (US); Tak-Yiu Wong, Cerritos, CA (US)

(73) Assignee: SAFETY ARMS SYSTEMS, Wildomar, CA (US)

( * ) Notice: Subject to any disclaimer, the term of this patent is extended or adjusted under 35 U.S.C. 154(b) by 0 days.

(21) Appl. No.: 17/960,226

(22) Filed: Oct. 5, 2022

Related U.S. Application Data

(60) Provisional application No. 63/253,033, filed on Oct. 6, 2021.

(51) Int. Cl.
*F41A 17/06* (2006.01)
*F41A 17/46* (2006.01)

(52) U.S. Cl.
CPC ..... *F41A 17/06* (2013.01); *F41A 17/46* (2013.01)

(58) Field of Classification Search
CPC ..... F41A 17/06; F41A 17/46
USPC ..... 42/70.11
See application file for complete search history.

(56) References Cited

U.S. PATENT DOCUMENTS

| | | | | |
|---|---|---|---|---|
| 3,292,492 | A * | 12/1966 | Sturtevant | F41A 17/46 89/142 |
| 4,693,170 | A * | 9/1987 | Atchisson | F41G 1/06 89/149 |
| 10,514,223 | B1 * | 12/2019 | Rounds | F41A 19/12 |
| 10,948,252 | B1 * | 3/2021 | Bender | F41A 17/46 |
| 11,333,457 | B1 * | 5/2022 | DeVoe | F41A 17/76 |
| 2015/0068090 | A1 * | 3/2015 | Christensen | F41A 17/46 42/69.01 |
| 2015/0330734 | A1 * | 11/2015 | Kolev | F41A 19/27 42/69.01 |
| 2018/0328687 | A1 * | 11/2018 | McInerney, III | F41A 17/46 |
| 2019/0257606 | A1 * | 8/2019 | Olson | F41A 19/10 |
| 2021/0003358 | A1 * | 1/2021 | Spuhr | F41A 19/15 |
| 2022/0214126 | A1 * | 7/2022 | Afshari | F41A 19/17 |

* cited by examiner

*Primary Examiner* — Samir Abdosh
(74) *Attorney, Agent, or Firm* — Cislo & Thomas, LLP

(57) ABSTRACT

A firearm locking system that can lock a trigger by remote activation by an authorized user using a trigger lock that can block a trigger of a firearm from being pulled sufficiently to fire the firearm, The trigger lock can be advanced forward into the locked configuration and retracted into an unlocked configuration with the use of an actuator, such as a motor, Tamper-resistant features can be employed to prevent unauthorized users from disabling the firearm locking system. For example, when the trigger lock blocks the trigger, the trigger lock can also lock the upper receiver from being removed preventing access to the firearm locking system from the top of the firearm. The actuator or can be detachably connected to the trigger lock such that when the grip is removed, the actuator disconnects from the trigger lock causing the trigger lock to enter a jammed configuration.

8 Claims, 10 Drawing Sheets

FIREARM LOCKING SYSTEM

TECHNICAL FIELD

This invention relates to methods and systems for locking a firearm or otherwise rendering the firearm inoperable.

BACKGROUND

Mass shootings are a major problem in the U.S. Current proposals revolve around implementations of laws to restrict firearm ownership and use. Proponents of the Second Amendment, however, find these laws to be a violation of their Constitutional Rights.

For the foregoing reasons there is a need for a system that reduces or prevents mass shootings without violating the Second Amendment of the Constitution.

SUMMARY

The present invention is directed to a firearm locking system that prevents a firearm from firing. The firearm locking system uses wireless communications, such as a cell phone or computer, to allow an authorized user of a firearm to control when the firearm can be fired or locked from firing. Remote activation of the firearm locking system causes a trigger lock to engage the trigger system of the firearm to prevent the trigger from being pulled. The trigger lock can engage the trigger system regardless of whether the safety of the firearm is turned on or off.

In some embodiments, the firearm locking system is also configured to be tamper-proof to prevent unauthorized users of the firearm to open the firearm in an attempt to disable the firearm locking system.

In some embodiments, the upper receiver of any AR-style rifle can have a receiver lock. The trigger lock can be configured to engage both the trigger and the receiver lock so that the trigger cannot be pulled and the upper receiver cannot be removed.

In some embodiments, the actuator that moves the trigger lock in the locked and unlocked configuration can be housed in the grip of the firearm in such a manner that when the actuator is removed, the actuator is disengaged from the trigger lock, and the trigger lock enters the locked configuration.

In some embodiments, a steel plate can surround the handles to prevent unauthorized users from breaking into the lower receiver in an attempt to bypass the trigger lock.

Essentially, any attempt, to tamper with the firearm locking system causes the firearm locking system to lock or requires the unauthorized user to disassemble so much of the firearm that the firearm is rendered inoperable.

DETAILED DESCRIPTION OF THE INVENTION

The detailed description set forth below in connection with the appended drawings is intended as a description of presently-preferred embodiments of the invention and is got intended to represent the only forms in which the present invention may be constructed or utilized The description sets forth the functions and the sequence of steps for constructing and operating the invention in connection with the illustrated embodiments. It is to be understood, however, that the sane or equivalent functions and sequences may be accomplished by different embodiments that are also intended to be encompassed within the spirit and scope of the invention. For example, the firearm locking system 100 is described herein using an AR-15 rifle as a model, but the concepts can be implemented in any firearm with some modifications.

In addition directional terms are not meant to be limiting. Rather, directional terms are used as convenient nomenclature to efficiently describe the invention. In the present application, the directional terms will he based on the firearm being properly held and in firing position. By way of example only, front, forward, and like terms refer to the end of the firearm towards the barrel and muzzle, Back, rearward, behind, and like terms refer to the end of the firearm buttressed against the user, such as the buttstock of a rifle. Top, upward, above, and like terms refer to the top side of the firearm typically where the sights are located. Bottom, downward, below, and like terms refer to the portion of the firearm where the grips and trigger are located.

Figure 1:
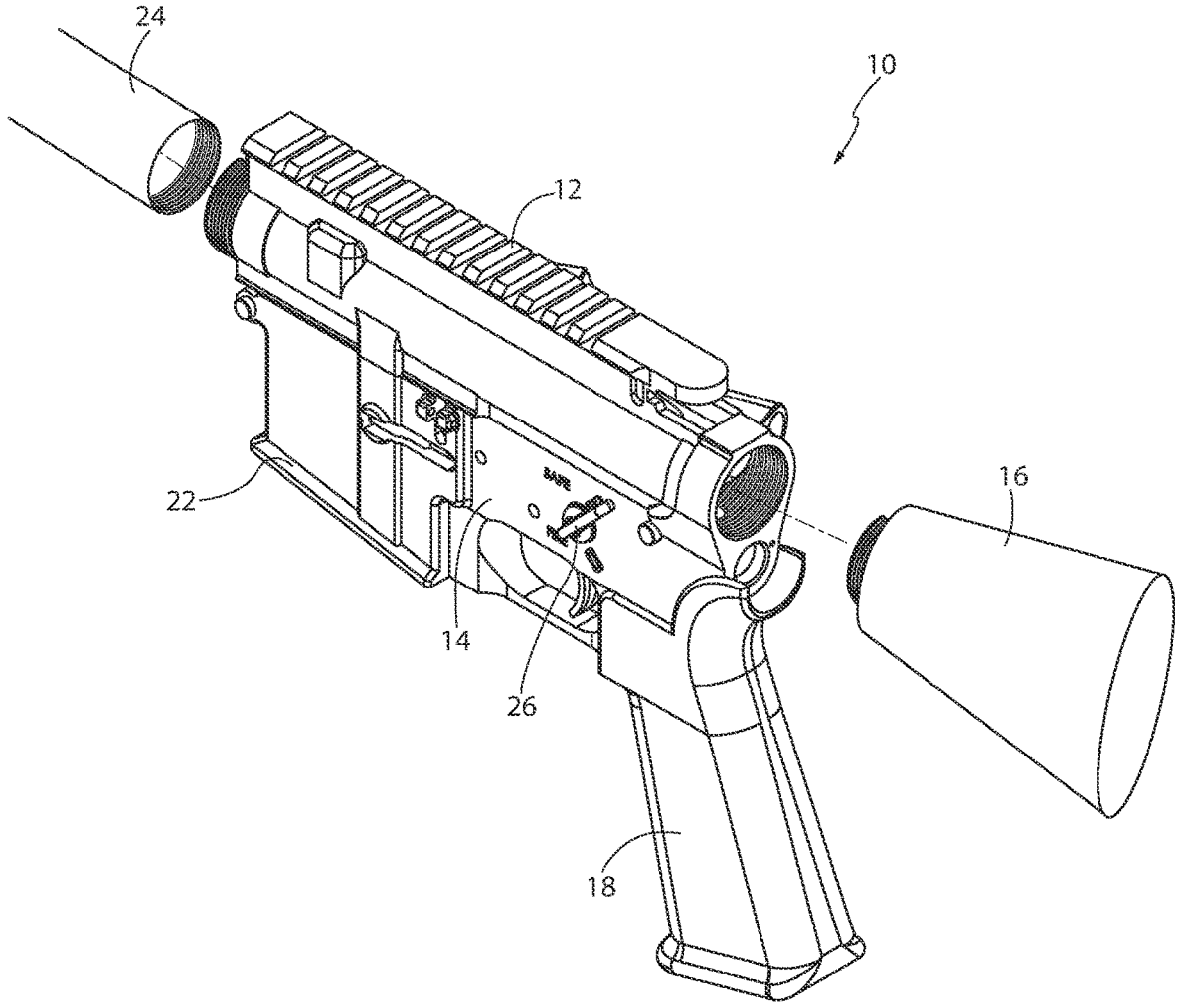
FIG. 1 shows a partially exploded perspective view from the top rear of an embodiment of the present invention.
Figure 2:
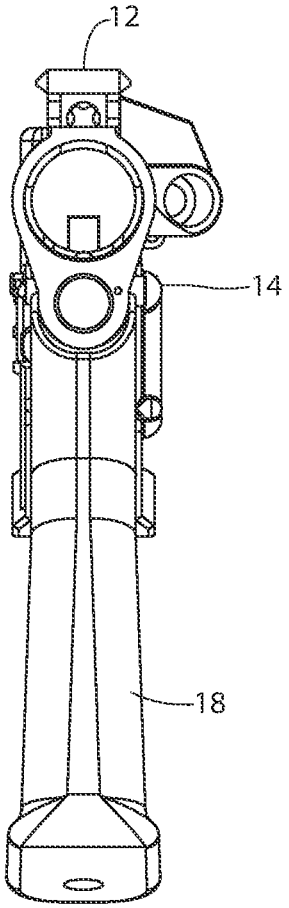
FIG. 2 shows a rear of the embodiment shown in FIG. 1 with the buttstock removed.

With reference to FIGS. 1 and 2, a firearm 10, such as an AR-style rifle, comprises an upper receiver 12 mounted on a lower receiver 14, a buttstock 16 mounted behind the upper and lower receivers 12, 14, a grip 18 mounted under the lower receiver 14, a trigger system 20 housed inside the lower receiver 14, a magazine well 22 in front of the trigger system 20, and a barrel 24 projecting forwardly from the upper receiver 12. Typically, a safety 26 is used to prevent the trigger system 20 from being actuated.

With reference to Figs, 3-5, the trigger system 20 comprises a trigger 30 descending from a base plate 32 housed inside the lower receiver 14, the trigger 30 projecting downwardly from the lower receiver 14, The base plate 30 of the trigger 30 can be operatively connected to a disconnector 33 and a spring-loaded hammer 34. The hammer 34 can have a cocked configuration and a released configuration, wherein the spring-loaded hammer 34 can be configured to enter the released configuration when the trigger 30 is pulled. Typically, the front end 35 of the base plate 32 catches a sear 37 of the hammer 34 when the hammer 34 is in the cocked position. When the trigger 30 is pulled, the base plate 32 teeters in which the back end 39 of the base plate 32 rises and the front end 35 of the base plate 32 lowers. When the front end 35 of the base plate 32 lowers, the front end 35 of the base plate 32 slides out of the sear 37 causing the spring-loaded hammer 34 to be released. The spring operatively connected to the hammer 34, causes the hammer 34 to propel forward striking the ammunition, which results in an explosion that cases a bullet to propel through the barrel 24. The explosion also causes the spring-loaded hammer 34 to return towards its cocked position allowing the disconnector 33 to temporarily catch the spring-loaded hammer 34. As the trigger 30 is released, the front end 35 of the base plate 32 teeters upward causing the disconnector 33 to release the hammer 34, and allowing the hammer 34 to be re-seated back in the sear 37, resulting in the spring-loaded hammer 34 to be in the cocked position again, ready for firing when the trigger 30 is pulled.

Figure 7:
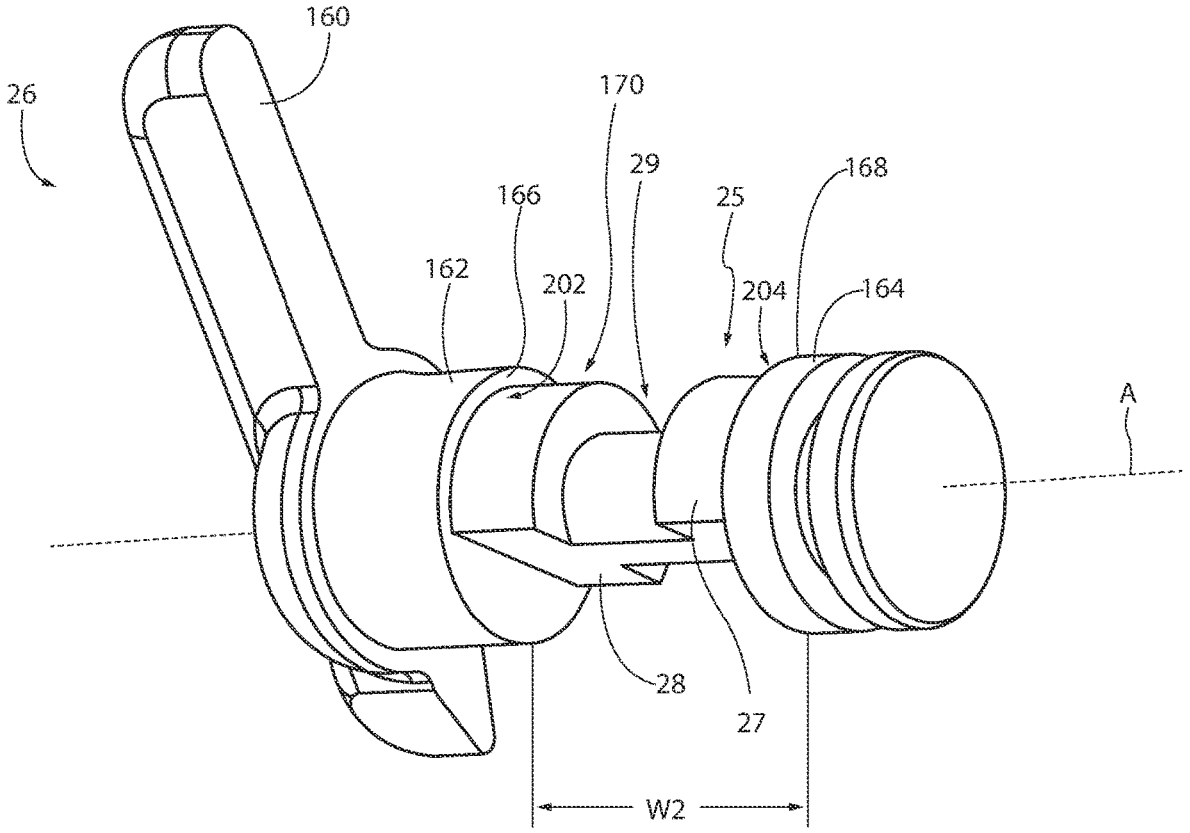
FIG. 7 shows a close up perspective view of an embodiment of a safety.

To prevent the trigger 30 from being pulled, the firearm 10 can have a safety 26. With reference to FIG. 7, the safety 26 comprises a blocking cylinder 25 defining a longitudinal axis A. The blocking cylinder 25 can actually be a partial cylinder having a substantially flat longitudinal portion along a plane that is perpendicular to two opposing flat ends 202, 204 of the blocking cylinder 25 creating a longitudinal flat face 28 along the length of the blocking cylinder 25 that is perpendicular to the flat ends 202, 204. In other words, the blocking cylinder 25 comprises a first flat end 202, a second flat end 204 opposite the first. flat end 202, and a curved face 27 on one portion of the blocking cylinder 25, and a flat face 28 on another portion of the blocking cylinder 25. As such, the flat face 28 is in between the first flat end 202 and the second flat end 204, and adjacent to the curved face 27, wherein the longitudinal axis A is parallel to the flat face 28 and perpendicular to the first flat end 202 and the second flat end 204. The blocking cylinder 25 is configured to rotate about the longitudinal axis A into a safety-on configuration, in which the curved face 27 is directed towards the back end 39 of the base plate 32, and a safety-off configuration, in which the flat face 28 is directed towards the back end 39 creating a gap 210 between the flat face 28 and the back end 39 sufficient to allow the trigger 30 to be pulled.

Figure 3:
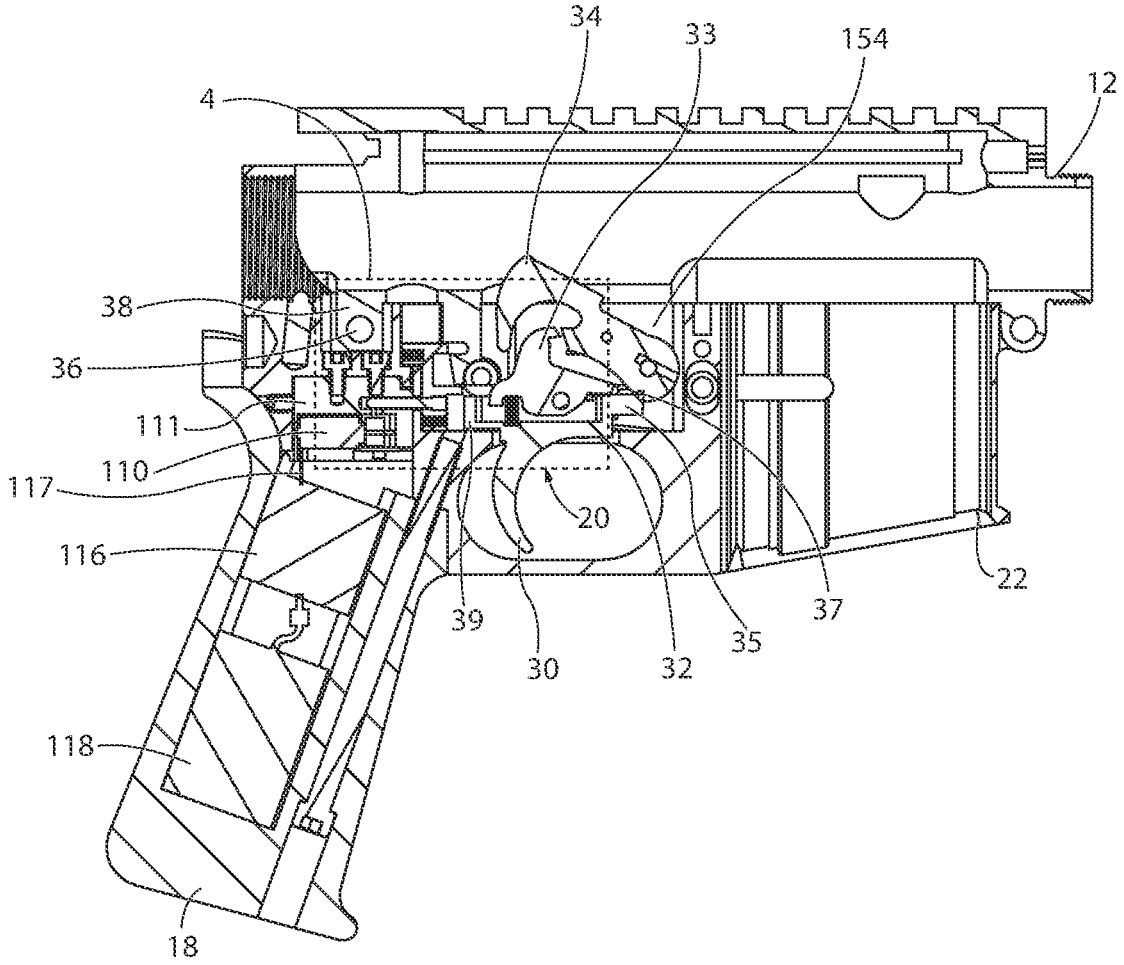
FIG. 3 shows a side view of a cross-section taken along about line 3-3 in FIG. 2 of an embodiment of the present rove .on with some components removed for clarity.
Figure 4:
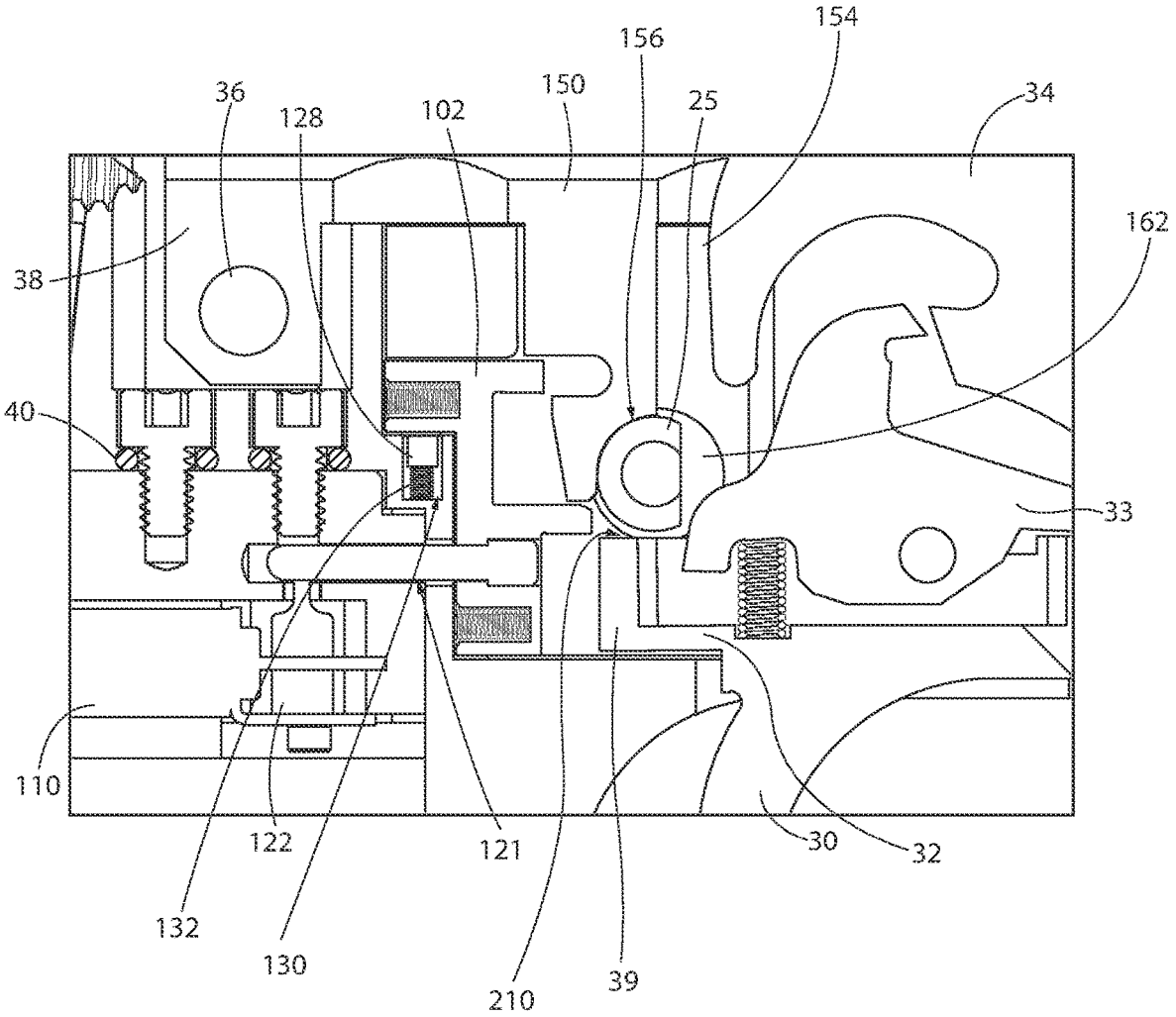
FIG. 4 shows a close up of the side view designated as 4 in FIG. 3 with the safety in the on configuration and the trigger lock in the unlocked configuration.

As shown in FIG. 4, when the safety 26 is on, the curved face 27 is directed towards the back end 39 of the base plate 32 sufficiently reducing the size of the gap 210 and blocking the back end 39 of the base plate 32 from rising sufficiently to cause release of the hammer 34. As shown FIG. 3, when rhea the safety 26 is off, the longitudinal fiat face 28 is directed towards the back end 39 of the base plate 32. Because the longitudinal flat face 28 is in essence a cut out of the curved face 27 the gap 210 is larger between the back end 39 of the base plate 32 and the longitudinal flat face 206. This gap 210 is sufficiently large that the back end 39 of the base plate 32 can rise enough to release the hammer 34.

In the present invention, the firearm locking system 100 can be mounted in the lover receiver 14 of an AR-style rifle behind the trigger system 20 to block actuation of the trigger system 20 regardless of whether the safety 26 is on or off. Preferably, actuation of the trigger system 20 is blocked by preventing the back end 39 of the base plate 32 of the trigger system 20 from rising.

Figure 5:
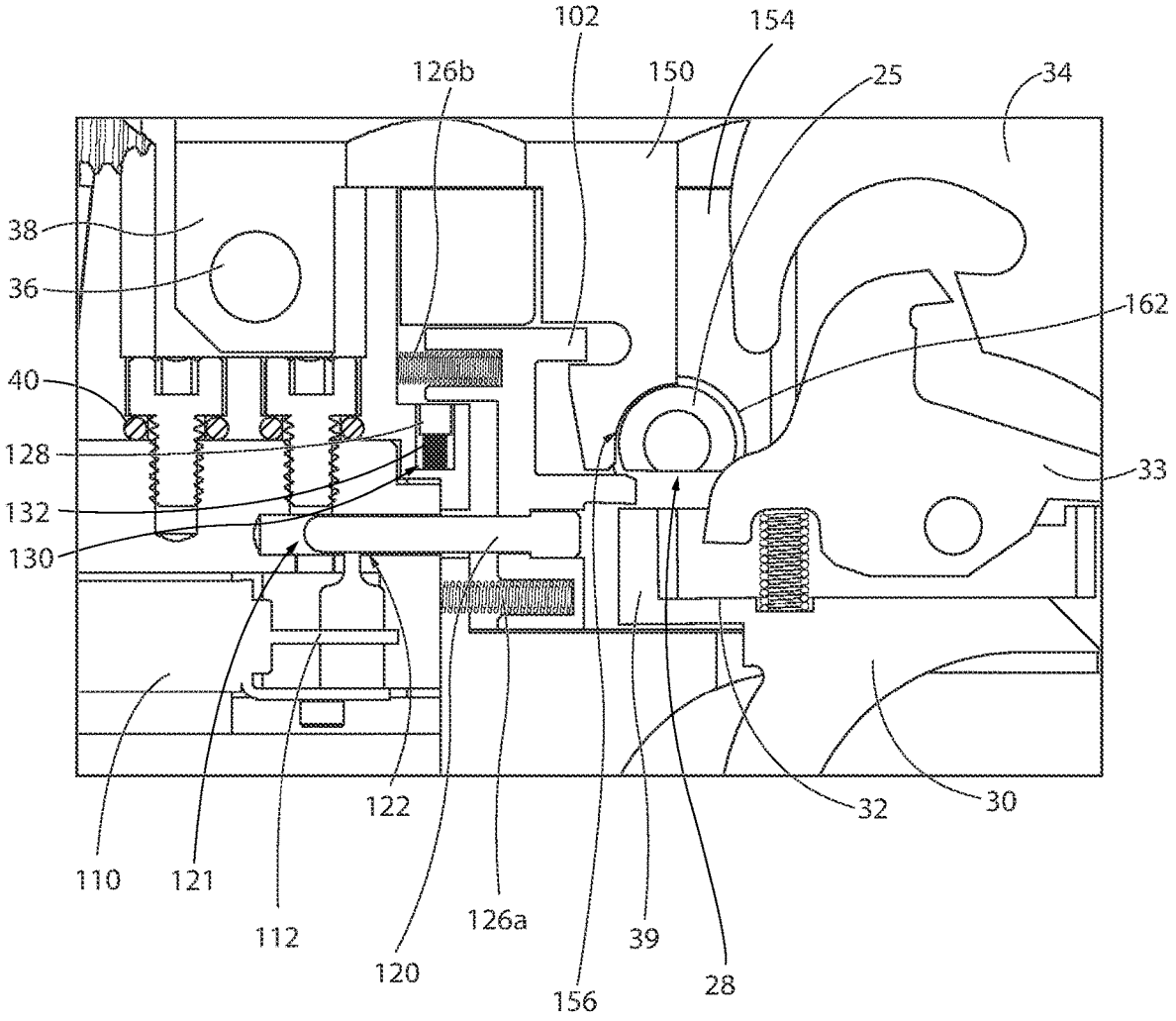
FIG. 5 shows a close up of the side view designated as 4 in FIG. 3 with the safety in the off configuration and the trigger lock in the locked configuration.

In the preferred embodiment, the firearm locking system 100 uses a trigger lock 102 to block the actuation of the trigger system 20, wherein the trigger lock 102 can be actuated remotely using wireless signals, for example via a phone, tablet, computer, and the like. By being able to remotely actuate the firearm locking system 100, if an unauthorized user obtains a firearm 10 with the firearm locking system 100 installed, the firearm locking system 100 can be actuated from almost anywhere to prevent firearm 10 from being fired. such, countless lives can be saved with the implementation of the firearm locking system 100. As FIGS. 3-5 show a side view of an AR-style rifle 10 with portions removed for clarity to show how embodiments of the firearm locking system 100 functions. FIG. 3 shows the locking system 100 disengaged in the unlocked configuration, with safety 26 in the off position in which the longitudinal flat face 28 of the safety 26 is now facing the back end 39 of the base plate 32 creating a gap 210 that allows the back end 39 of the base plate 32 to rise when the trigger 30 is pulled. This configuration allows the firearm 10 to be fired.

FIG. 4 shows a close up side view of the AR-style rifle with the locking system 100 disengaged in the unlocked configuration, but with the safety 26 in the on position. As such, when the trigger 30 is pulled, the back end 39 of the base plate 32 of the trigger 30 abuts against the curved face 27 of the safety 26 preventing the trigger 30 from being pulled sufficiently to release the cocked hammer 34.

FIG. 5 shows the same side elevation view as FIG. 4, but with the firearm locking system 100 engaged in the locked configuration with the safety 26 in the off position. As shown, the trigger lock 102 has advanced forward to occupy the gap 210 between the safety 26 and the back end 39 of the base plate 32 of the trigger system 20. As such, the back id 39 of the base plate 32 can no longer rise due to the obstruction by the trigger lock 102, and therefore, the trigger 30 cannot be pulled to disengage the hammer 34 even though the safety 26 is off.

Figure 6:
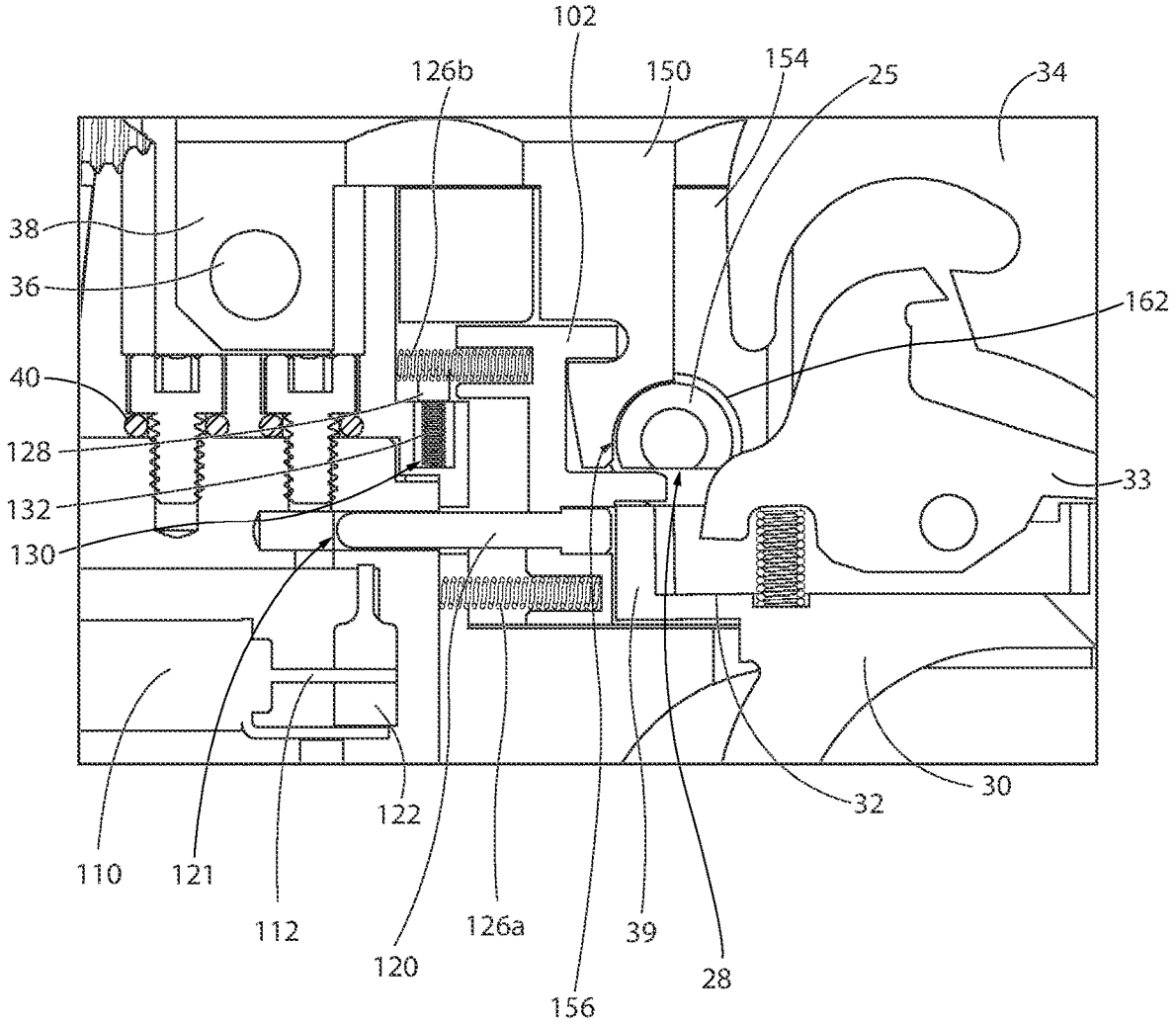
FIG. 6 shows a close up of the side view designated as 4 in FIG. 3 with the safety in the off configuration and the trigger lock in the jammed configuration.

FIG. 6 shows the same side elevation view as FIG. 4, but the firearm locking system 100 in a jammed configuration described in more detail below. Essentially, the locking system 100 has advanced slightly more forward to release tampering mechanisms to prevent the locking system 100 from returning to an unlocked configuration.

The firearm locking system 100 comprises a trigger lock 102 that is not only configured to advance forward into the locked configuration, but also to retract backward to the unlocked configuration. This movement can be controlled remotely using a phone, tablet, computer, and the like. Therefore, after the locking system 100 has been activated, it can be deactivated once it is determined that use of the firearm 10 will be lawful.

However, those with ill intentions may attempt to disable the firearm locking system 100 in an attempt to use the firearm 10 in an unauthorized manner before or after the locking system 100 has been activated. As such, the locking system 100 can further comprise one or more tamper-resistant systems to prevent unauthorized users from attempting to disable the firearm locking system 100.

For example, in some embodiments, the tamper-resistant system can comprise a mechanism configured to jam the trigger lock 102 in the locked configuration when attempts are made to tamper with the trigger lock 102. Specifically, attempts at disassembling or removing components of the firearm 10, such as the grip 18, can cause the trigger lock 102 to enter a permanently locked configuration meaning that the trigger lock 102 cannot be moved to the unlocked configuration remotely with a phone, tablet, computer and the like. When the trigger lock 102 enters the permanently locked configuration, the firearm 10 must be disassembled in order to reset the firearm locking system 100. Disassembly of the firearm 10 renders the firearm 10 useless.

In some embodiments, the tamper-resistant system may prevent the firearm 10 from being disassembled easily or in its customary manner. For example, an AR-15 can be disassembled by removing the upper receiver 12 from the lower receiver 14. In some embodiments, the tamper-resistant system can lock the upper receiver 12 to the lower receiver 14 to prevent removal of the upper receiver 12 from the lower receiver 14. For example, the trigger lock, which is attached to the lower receiver 14, can engage a receiver lock 150 mounted on the upper receiver 12 when the trigger lock 102 is advanced forward. As such, in the preferred embodiment, the trigger lock 102 is configured to jam the trigger 30 and lock the upper receiver 12 to the lower receiver 14 at the same time, in one action, when attempts are made to tamper with the firearm locking system 100.

Figure 8:
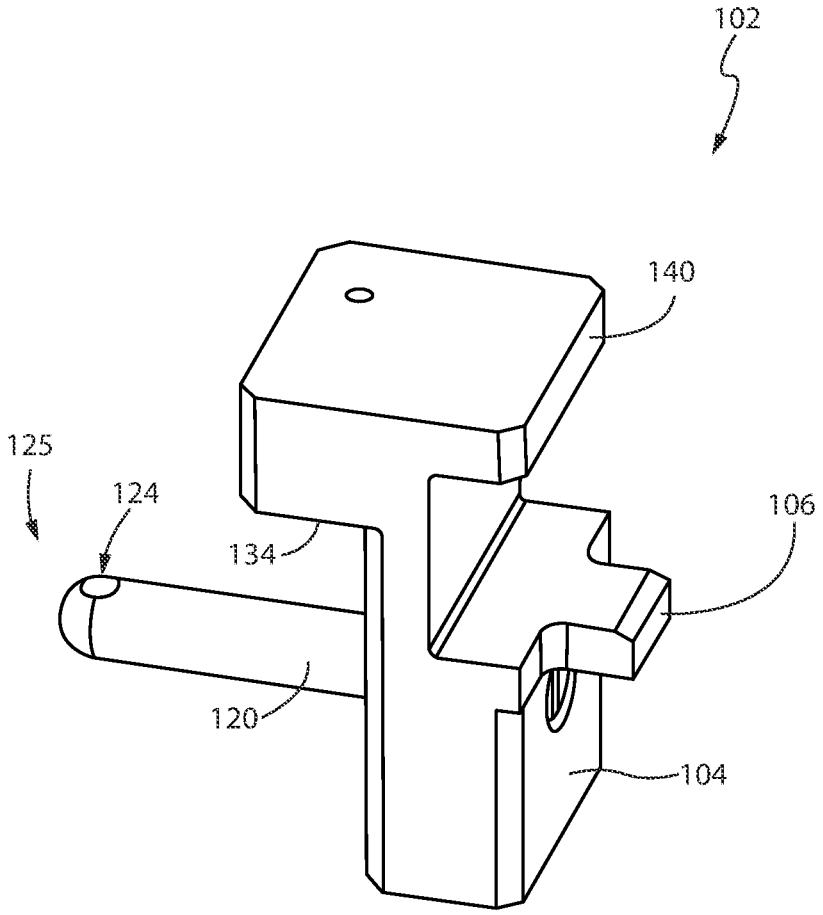
FIG. 8 shows a close up perspective view of an embodiment of a trigger lock.

By way of example only, FIG. 8 shows a close-up perspective view of an embodiment of the trigger lock 102 that can carry out the functions described above. In the preferred embodiment, the trigger lock 102 comprises a base 104 and a first bar 106 operatively connected to the base 104 and configured to advance forward into a locking configuration in which the trigger 10 cannot be pulled, and to retract into an unlocked configuration in which the trigger 10 can be pulled. Preferably, the first bar 106 slid to the gap 210 between the back end 39 of the base plate 32 of the trigger system 20 and the safety 26. When inserted in between the base plate 32 and the safety 26, the base plate 32 cannot rise sufficiently to release the hammer 34.

To engage the trigger lock 102 into the locked configuration, the base 104 is advanced in the forward direction towards the trigger 30. To disengage the trigger lock 102 into the unlocked configuration, the base 104 is retracted backward towards the buttstock 16 to enlarge the gap 210 between the safety 26 and the base plate 32 so that the back end 39 of the base plate 32 can rise into the gap 210 when the trigger 30 is pulled, the preferred embodiment, the safety 26 is modified as shown in FIG. 7 so that the trigger lock 102 can enter the locked configuration even when the safety 26 is on. Specifically, when the safety 26 is on, the gap 210 is eliminated or reduced by the curved face 27 facing the back end 39 of the base plate 32. Thus, with a normal safety, the trigger lock 102 may not be able to enter the gap 210. Therefore, the safety 26 of the present invention can comprise a recess 29 on a portion of the curved surface 27 to maintain the gap 210 to receive the first bar 106 of the trigger lock 102 even when the safety 26 is on, without interfering with the ability of the curved face 27 to block the back end 39 of the base plate 32. As such, the first bar 106 of the trigger lock. 102 can be configured to fit inside the recess 29 without interference from the curved face 27. Preferably, the recess 29 is centrally located between the first end 202 and the second end 204, thereby giving the blocking cylinder 25 a dumbbell-like shape in which the diameter of the first and second ends 202, 204 are larger than the middle portion due to the recess 29, Thus, the term cylinder used herein is not intended to be limiting to an e act cylindrical shape, but rather, also encompasses generally cylindrical shapes, even if not completely cylindrical, and partial cylinder shapes, including the shape shown in the figures attached hereto.

Figure 9:
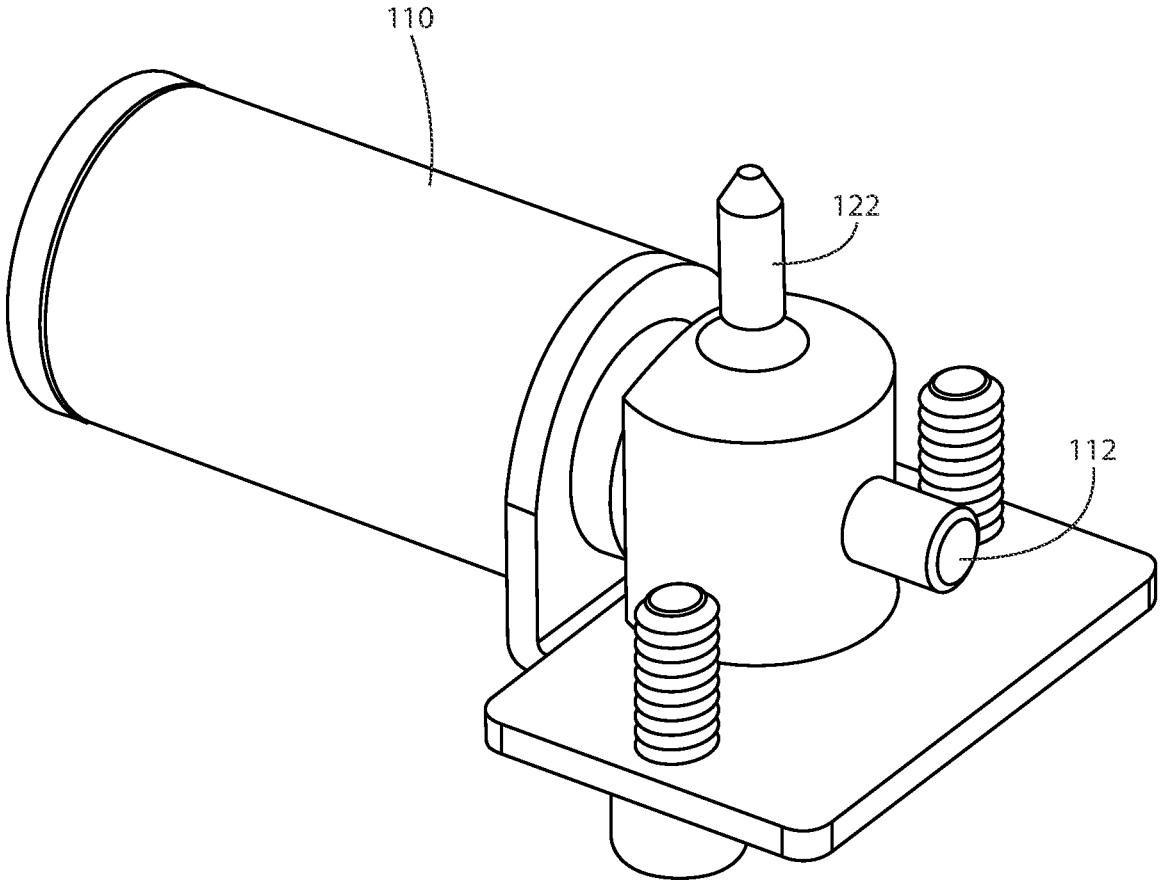
FIG. 9 shows a close up perspective view of an embodiment of an actuator.

To move the trigger lock 102 in the forward. and backward direction, the base 104 can be attached to an actuator 110 (see, FIGS. 3-5). By way of example only, FIG. 9 shows an embodiment of an actuator 110. The actuator 110 can be any mechanism that creates linear motion. For example, the actuator 110 can comprise a motor, a solenoid, magnets, springs, and the like. In the preferred embodiment, the actuator 110 is a motor, such as the Cqinju motor having a linear screw 112. The actuator 110 can be operatively connected to the base 104 of the trigger lock 102 to move the trigger lock 102 in the forward and backward direction. Movement of the trigger lock 102 in the forward direction slides the first bar 106 in between the gap 210 between the base plate 32 and the safety 26, and moving the trigger lock 102 in the rearward direction pulls the first bar 106 out from the gap 210 between the base plate 32 and the safety 26.

In the preferred embodiment, the base 104 of the trigger lock 102 can he attached to the actuator 110 by a rod 120 and pin 122. The rod 120 can extend rearwardly from the base 104 towards the actuator 110. The back end 125 of the rod 120 can have a hole 124. As shown in FIG. 9, the actuator 114 can have a linear screw 112 mounted thereon and a pin 122 mounted on the linear screw 112. The pin 122 can he attached to the back end 125 of the rod 120 by being inserted into the hole 124 at the back end 125 of the rod 120. This is the preferred connection to allow for tamper resistance as described below; however, the actuator 110 can be connected to the trigger lock 102 in other ways, including permanent attachments. Therefore, actuation of the actuator 110 causes the linear screw 112 to turn in one direction or another, which causes the pin 122 to move linearly in the forward or backward direction along the linear screw 112. The pin 122 being operatively connected to the rod 120, therefore, causes the rod 120 and the trigger lock 102 to move into and out of the locked configuration.

The actuator 110 can be operatively connected to an electronic system, such as electrical circuitry, microchips, and the like contained in a housing 116. The electronic system can be operatively connected to a wireless receiver that receives wireless communications from a remote location. An authorized user can then send a signal to the electronic system to activate the actuator 110 causing the trigger lock 102 to advance forward into the locked configuration or retract backward into the unlocked configuration. In the preferred embodiment, the actuator 110 is mounted on the top of the housing 116 Electrical wires 117 for the actuator 110 emerge from an opening at the top of the housing 116. Having the actuator 110 and electrical wires 117 mounted at the top of the housing 116 reduces the ability that an unauthorized user would be able to access and tamper with the actuator 110 or electrical wires 117 when o g through the grip 18. In some embodiments, the housing 116 can be secured to the grip 18 so tightly that whet the grip 18 is removed, the actuator 110 is disengaged from the trigger lock 102.

A battery 118 can be operatively connected to the electronic system to power the electronics on the device. Preferably, the battery 118 can be connected to the actuator 110 using a quick connect system such as the Airnix heat shrink wire connectors electrical terminal kit. Additional features can he added to detect the amount of power remaining in the battery, including LED lights and alarms. To create a fail-safe system, the firearm lock system 100 can be configured to automatically enter the locked configuration when or just before the battery dies or some other predetermined level. For example, when the battery 118 is detected to have only about 1 percent to about 10 percent of power remaining, the firearm lock system 100 can automatically enter the locked configuration, This fail-safe system prevents an unauthorized user to simply wait for the battery 118 to die before using the firearm 10. A charging port, as known in the art, can be provided to charge the battery 118 when not in use. This will increase the likelihood that the battery 118 is fully charged in the event of an emergency when the authorized user is in need of the firearm 10.

Aside from battery failure, as with any electronic device, the system can malfunction. Of particular concern is potential water damage. protect the firearm locking system 100, the actuator 110 can be protected inside a compartment 111 with water barriers 40 placed at potential water or moisture entry points. The water barrier 40 can be water-proof or water-resistant material, such as resins, epoxies, sealants, gaskets, o-rings, and the like. Portions of the firearm having a higher potential for water entry can be lined with the water barrier 40. In some embodiments, the firearm locking system 100 can be protected from full submersion under water. In some embodiments, the firearm locking system 100 can be protected from splashes, rain, and other temporary water exposure.

To reduce tampering of the firearm locking system 100, tamper-resistant features may be employed in some embodiments, attempting to remove the grip 18 to disable the electronic system or the actuator 110 can automatically jam the firearm locking system 100 in a locked configuration by having the actuator 110 detach from the trigger lock 101 in normal operation when the actuator 110 is connected to the trigger lock 102 via the rod 120, the actuator 110 allows the trigger lock 102 to temporarily enter the locked configuration as discussed above, When the actuator 110 is disconnected from the trigger lock 102, however, the trigger lock 102 is permanently in the locked configuration (jammed) requiring disassembly of the firearm 10 to fix the problem. In other words, normal function of the firearm locking system 100 cannot remove the trigger lock 102 from the jammed configuration and the firearm 10 would have to undergo further disassembly to re-engage the actuator 110 with the trigger lock 10

For example, as shown in FIG. 6, when the actuator 110 is removed (in this example, when the grip 18 is removed), the pin 122 falls out from the rod 120. One or snore springs 126*a*, 126*b* can be buttressed against the base 104 of the trigger lock 102 imposing a biasing force in the forward direction. As such, when the pin 122 is removed from the rod 120, the rod 120 is effectively disconnected from the actuator 110. Being disconnected from the actuator 110, the rod 120 is free to move in the forward and backward direction without restriction by the actuator 110. Because the springs 126*a*, 126*b* bias the trigger lock 102 in the forward direction, without the connection to the actuator 110, the trigger lock 102 moves in the forward direction. Due to the action of the springs 126*a*, 126*b*, the rod 120 is pushed deeper into the lower receiver 14. Preferably, the lower receiver 14 defines a channel 121 in which the rod 120 slides linearly, When the rod 120 is disconnected from the pin 122, the rod 120 disappears into the channel 121 making the rod 120 generally inaccessible from the grip 18 area. As such, it would be very difficult for an unauthorized user to be able to grasp the back end 125 of the rod 120 to pull the rod 120 in the backward direction. Other detachable systems can be used in which the connection between the actuator 110 and the trigger lock 102 is detachable. For example, various types of clamps, adhesives, magnets, clips, hooks, and the like can be used.

In some embodiments, another tamper-resistant feature can be to physically block the trigger lock 102 in the locked configuration rather than making the trigger lock 102 inaccessible, For example, a second pin 128 can be mounted on the lower receiver 14 behind the trigger lock 102 such that when the rod 120 is connected to the actuator 110, the second pin 128 is in a stowed configuration and the trigger lock 102 is free to move forward and backward as shown in FIGS. 3-5. However, when the trigger lock 102 moves too far forward, such as when the pin 122 is removed from the rod 120, then the second pin 128 is deployed into the pathway behind the trigger lock 102, thereby blocking the rearward movement of the trigger lock 102 as shown in FIG. 6. Therefore, even if an unauthorized user is able to grasp the back end of the rod 120 from the grip area, the unauthorized user would not be able to slide the rod 120 in the backward direction due to the second pin 128 blocking the pathway.

By way of example only, the second pin 128 can be housed in a recess 130 in the lower receiver 14. The second pin 128 can be biased upwardly, for example, with a spring 132. A tab 134 can extend backwardly from the base 104 of the trigger lock 102 above the first bar 106. Under normal operating circumstances, the tab 134 rests on top of the recess 130 with the second pin 128 housed therein. As such, the tab 134 keeps the second pin 128 in the stowed configuration. As the trigger lock 102 moves back and forth during normal operation (FIGS. 3-5), the tab 134 is sufficiently large enough to continuously maintain pressure on the second pin 128. Only when the first pin 122 is removed from the rod 120 does the tab 134 move sufficiently clear of the recess 130 that the second pin 128 would pop out (FIG. 6) into a jammed configuration in which the second pin 128 is positioned in the linear path of the trigger lock 102 to prevent the trigger lock 102 from returning to the unlocked configuration. In some embodiments, a barrier above the second pin 128 can prevent the second pin from moving passed the pathway of the tab 134. In some embodiments, the spring 132 may be long enough only to place the second pin 128 in the path of the tab 134, but no further. As such, the second pin 128 blocks the rearward travel of the tab 134, and therefore, the trigger lock 102. Other mechanisms can be used to prevent the trigger lock 102 from returning back to an unlocked configuration, such as a catch, hook, and the like that can block rearward movement of the trigger lock 102.

Aside from tampering through the grip 18, an unauthorized user may attempt to remove the upper receiver 12 from the lower receiver 14 to disable the firearm locking system 100 from the top. In some embodiments, to prevent unauthorized access to the firearm locking system 100 by removal of the upper receiver 12, the trigger lock 102 can be configured to lock the upper receiver 12 when the firearm locking system 100 is in the locked configuration. For example, the trigger lock 102 can have a second bar 140 that can catch a solid, sturdy component of the upper receiver 12 to prevent the upper receiver 12 from being removed from the lower receiver 14.

Figure 10:
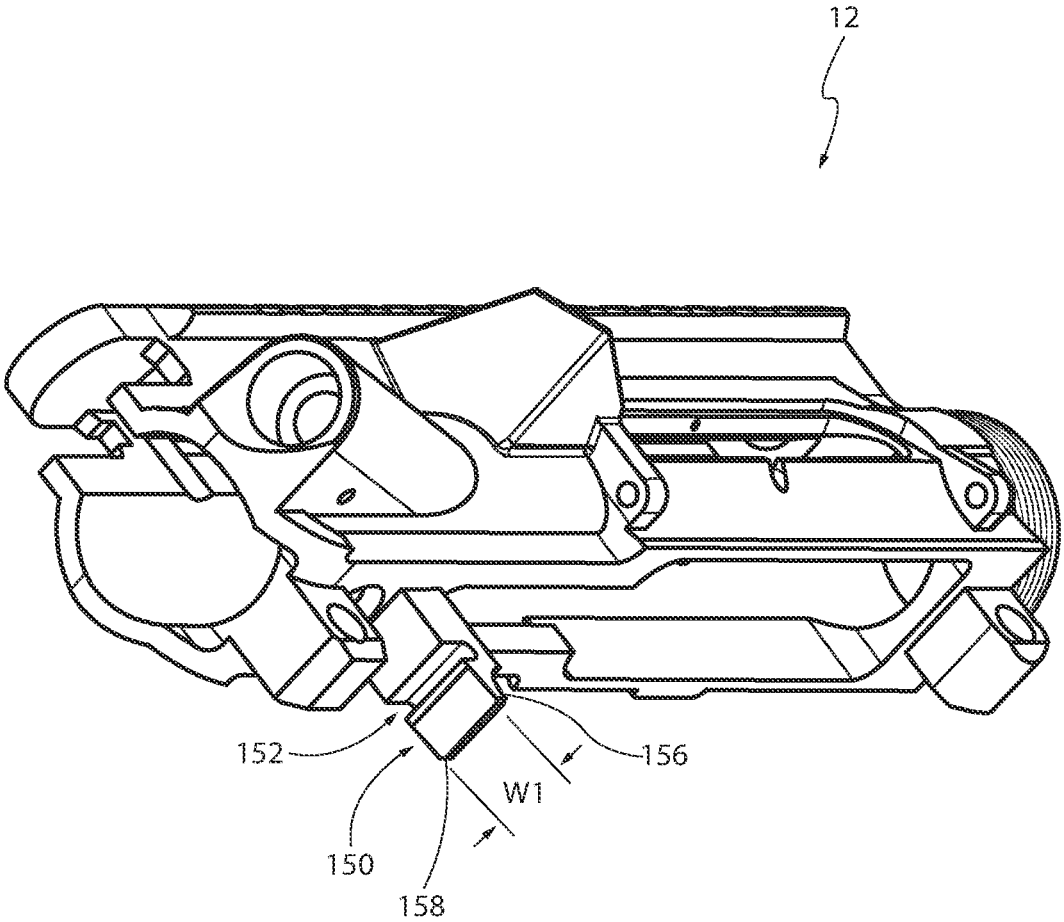
FIG. 10 shows a perspective view of an embodiment of an upper receiver.

For example, in some embodiments, the upper receiver 12 can be configured with a receiver lock 150 as shown in FIG. 10, The receiver lock 150 can be fixedly attached to the upper receiver 12 and descends towards the trigger lock 102. When the trigger lock 102 is in the unlocked configuration, the second bar 140 is disengaged from the receiver lock 150 as shown in FIGS. 3 and 4. When the trigger lock 102 is in the locked configuration, the second bar 140 is engaged with the receiver lock 150 as shown in FIG. 5. Engagement of the second bar 140 with the receiver lock 150 prevents the upper receiver 12 from being lifted away from the lower receiver 14. By way of example only, the receiver lock 150 can be a sturdy bar with an opening 152, such as a recess or hole. The second bar 140 can be operatively connected to the top of the base 104 above the first bar 106. When in the locked configuration, the second bar 140 is inserted into the opening 152 of the receiver lock 150.

In some embodiments, the second bar 140 can interfere with the rear takedown pin 36 so that the rear takedown pin 36 of the upper receiver 12 cannot be removed, For example, generally the rear takedown pin 36 is cylindrical in shape.

Locking tabs 38 on the upper receiver 12 and the lower receiver 14 can overlap and the rear takedown pin 36 in inserted therein to lock the upper receiver 12 to the lower receiver 14. To remove the upper receiver 12 from the lower receiver 14, the rear takedown pin 36 simply needs to be knocked out from the overlapping tabs 38, by pushing the rear takedown pin 36 along its longitudinal axis. In some embodiments, the rear takedown pin 36 can be modified with a recess. For example, the rear takedown pin 36 can be in the shape of a dumbbell (similar to the safety 26) where its diameter is smaller in the middle portion than at the two opposing ends. The second bar 140 can be positioned adjacent to the rear takedown pin such then when in the locked configuration, the second bar 140 slides into the recess of the rear takedown pin 36, This configuration prevents the rear takedown pin 36 from moving axially along its longitudinal axis. As such, the rear takedown pin 36 cannot be dislodged and the upper receiver 12 cannot be removed.

In some embodiments, these two tamper resistant mechanisms to prevent removal of the upper receiver 12 can be combined such that when the trigger lock 102 is advanced forward into the locked configuration, a portion of the second bar 140 (e.g., the front portion) can catch the receiver lock 150, and a second portion of the second bar 140 (e.g., back portion) can be inserted into the recess of the rear takedown pin 36. Other locks can be used to automatically and simultaneously lock the upper receiver 12 to the lover receiver when the trigger lock is engaged.

In some embodiments, as another tamper-resistant feature, the receiver lock 150 can be configured to prevent the safety 26 from being dislodged from the lower receiver 14. For example, the receiver lock 150 and the safety 26 can be configured such that a portion of the receiver lock can block lateral movement of the safety 26 without affecting rotational movement of the safety 26 about its longitudinal axis A. Typical safeties 26 comprises a switch 160 operatively connected to two mounting cylinders 162, 164 that are concentrically aligned but spaced apart axially (along the longitudinal axis A). The mounting cylinders 162, 164 allow the safety 26 to mount on to the frame of the lower receiver 14 with the switch 160 presented on the outside of the lower receiver 14 accessible to the user, and the remainder of the safety 26 inside the lower receiver 14. The user can flip the switch 160 to turn the safety 26 on and off by causing either the curved face 27 of the blocking cylinder 25, or the flat face 28 of the blocking cylinder 25 to be directed towards the base plate 32 of the trigger 30. The blocking cylinder 25 of the present invention (if it vas a complete cylinder without the flat face) can be characterized as being coaxially aligned and residing in between the two mounting cylinders 162, 164 as shown in FIG. 7. The diameter of the blocking cylinder 25 is smaller than the diameter of the mounting cylinders 162, 164. As a result, the mounting cylinders 162, 164 each form a lip 166, 168 where the mounting cylinders 162, 164 attach to the respective flat ends 202, 204 of the blocking cylinder 25. In other words, the blocking cylinder 25 is recessed radially inward relative to the mounting cylinders 162, 164. Therefore, in the preferred embodiment, the safety 26 of the present invention comprises a double recess, the first recess 170 created moving from the mounting cylinders 162, 164 moving medially inwardly as the mounting cylinders 162, 164 step down to the blocking cylinder 25, and a second recess 29 defined at the central portion of the block cylinder 25 which creates the space into which the first bar 106 of the trigger lock 102 can be inserted when the safety 26 is in the on configuration.

The receiver lock 150 can have a lower portion 156 configured to be seated in the first recess 170. Therefore, the receiver lock 150 can be defined by a width W1 from one lateral side to the opposite lateral side of the receiver lock 150. The gap between the cylinder mounts 162, 164 can be defined by a width W2 as measured from the inner wall of the first mounting cylinder 162 (where the first mounting cylinder 162 is connected to the first end 202 of the blocking cylinder 25) to the inner wall of the second mounting cylinder 164 (wherein the second mounting cylinder 162 is connected to the second end 204 of the blocking cylinder 25). The width W1 of the lower portion 156 of the receiver lock 150 can he substantially the same as the width W2 of the cylinder mount gap. With this configuration, when the upper receiver 12 is mounted on the lower receiver 14, the lower portion 156 of the receiver lock 150 can be inserted into the gap between the cylinder mounts 162, 164. When the lower portion 156 of the receiver lock 150 resides within the first recess 170 lateral of the safety 26 is blocked because lateral movement of the safety 26 causes the mounting cylinders 162, 164 to abut against the lower portion 156 of the receiver lock 154, Therefore, an unauthorized user cannot tamper with the trigger lock by attempting to knock out the safety 26, In the preferred embodiment, the lower portion 156 of the receiver lock 150 can have a front curvature that is substantially similar to the radius of curvature of the blocking cylinder 25. This configuration allows the lower portion 156 of the receiver lock 150 to partially wrap around the blocking cylinder 25. In the example shown, the lower portion 156 of the receiver lock 150 wraps around about a quarter of the surface area of the blocking cylinder 25 (if the blocking cylinder 25 was complete), or a quarter turn round the blocking cylinder 25, This configuration increases the surface area of the receiver lock 150 that would abut against the mounting cylinders 162, 164 thereby strengthening the blocking capabilities of the receiver lock 150. This configuration also allows a rear portion 158 of the receiver lock 150 to descend directly above the first bar 106 with the trigger lock 102 in the locked configuration. As such, the receiver lock 150 can also serve as the blocker to prevent the trigger lock 102 from rising when the trigger 30 is pulled while the trigger lock 102 is in the locked configuration. Thus, when the trigger lock 102 is in the locked configuration, pulling the trigger 30 causes the back end 39 of the base plate 32 to abut against the first bar 106 causing the first bar 106 to rise. The first bar 106 then abuts against the blocking cylinder 25 and/or the rear portion 158 of the receiver lock 150 preventing the trigger 30 from being pulled sufficiently to fire the firearm 10.

In some embodiments, the interior of the lower receiver 14 can be lined with reinforcement plates 154 bilaterally arranged, adjacent to thy: trigger lock 102 and related components to prevent unauthorized users from drilling or cutting through the lower receiver 14 in an effort to disable the trigger lock 102 without removing the actuator 110 or the upper receiver 12. The reinforcement plate 154 can he any strong, durable material that reduces the ability of an unauthorized user to break into the lower receiver 14. For example, the reinforcement plate 154 can be made of steel, carbon, iron, and the like.

Any one or more of these tamper-resistant features, in any combination, can be used in the present invention.

In use, the authorized user can download an app that controls the firearm locking system 100. The app can be configured with authentication steps to make sure the authorized user is the one opening the app. If an unauthorized user acquires the firearm, as soon as the authorized user becomes aware that his or her firearm is in the hands of an unauthorized user, the authorized user can open the app and send a lock signal. The lock signal can be sent via any form of wireless communication, such as Wi-Fi™ technology, Bluetooth® technology, near field communication, cellular technology radio waves, RFID, and the like. Additional technology, such as the global positioning system can be used to track the location of the firearm.

Actuation of the firearm locking system 100 from the app sends a wireless signal to the firearm locking system 100, which activates the firearm locking system 100. The actuator 110 is turned on and drives the trigger lock 102 in the forward direction. Regardless of whether the safety 26 is on or off, the trigger lock 102 can lock the trigger 30, for example, by inserting the first bar 106 of the trigger lock 102 into whatever gap 210 exists between the base plate 32 of the trigger system 20 and the safety 26, As such, the trigger 30 cannot be pulled.

In some embodiments, to prevent tampering with the firearm locking system 100, forward movement of the trigger lock 10 also lock the upper receiver 12 to the lower receiver 14 automatically and simultaneously when the trigger lock 102 locks the trigger 30. For example, activation of the trigger lock 102 can cause a second bar 140 on the trigger lock 102 to advance forward and engage a receiver lock 150 mounted on the upper receiver 12 The receiver lock 150 fixed to the upper receiver 12 prevents a user from removing the upper receiver 12 from the lower receiver 14. In some embodiments, forward movement of the trigger lock 10 can also cause a back portion of the second bar 140 to enter a recess created in the rear takedown pin 36 preventing the rear takedown pin 36 from being removed.

In some embodiments, if the unauthorized user attempts to remove the grip 18 to access and disable the arm locking system 100, removal of the grip 18 disengages the actuator 110 from the trigger lock 102. Disengagement of the trigger lock 102 from the actuator 110 causes the trigger lock 102 to enter a permanently locked configuration, for example, by allowing springs 126*a*, 126*b* biased against the trigger lock 102 to advance the trigger lock 102 forward even further into the lower receiver 14 rendering the trigger lock 102 inaccessible. In other words, the trigger lock 102 would be disabled in the locked configuration.

In some embodiments, the trigger lock 102 can be disabled in the locked configuration by blocking the return path of the trigger lock, for example, by a second pin 128. In normal operation when the trigger lock 102 has not been tampered with, the second pin 128 is stowed under the tab 134 of the trigger lock 102, and kept in a stowed configuration during normal operation of the firearm locking system 100 as the tab 134 remains above the pin 128 during normal operation. However, when the pin 122 is disengaged from the trigger lock 102, the additional forward advancement of the trigger lock 102 causes the tab 134 to expose the second pin 128, which then pops up into the path of the tab 134 preventing the tab 134, and therefore, the trigger lock 102 from moving in the rearward direction, which is required to unlock the trigger lock 102. As such, even if an unauthorized user were to access the trigger lock 102, the unauthorized user would riot be able to move the trigger lock 102 backwards due to the blocking action of the second pin 128. Overcoming each of these tamper-resistant features would essentially ender the firearm useless.

In some embodiments, rather than having the authorized user send a lock signal to the firearm locking system 100, a lock signal can be sent automatically when the firearm 10 with the firearm locking system 100 enters a designated zone, such as schools, government buildings, and other public or private locations designated as a gun-free zone (or safe-gun zone). For example, the firearm locking system 100 can be configured with a distinct IP address for each firearm. A monitoring system can be established to store those IP addresses in a server. The monitoring system would provide the designated gun-free zones with a first communication device, such as a transmitter receiver that sends or receives information regarding the IP addresses, The firearm locking system 100 comprises a second communication device that can communicate with the first communication device. Thus, the IP address of the firearm entering a gun-free zone can be transmitted from the communication device on the firearm 10 to the communication device located in the gun-free zone, If the IP address of the firearm 10 matches an IP address in the database, a lock signal is automatically sent to the firearm locking system 100 to lock the firearm 10 and prevent the firearm from being tired. This feature may not apply to military and law enforcement agencies, and these agencies would own and keep their IP addresses. Other forms of automatic locking systems can he employed in which a firearm 10 entering a restricted zone is automatically locked using the firearm locking system 100 described herein, including the use of GPS, Wi-Fi™ technology, Bluetooth® technology, near field communication, cellular technology, radio waves, MID, and the like.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not he limited by this detailed description, but by the claims and the equivalents to the claims appended hereto.

What is claimed is:

1. A firearm with an automatic locking system, comprising:

a) a lower receiver;

b) an upper receiver mounted on the lower receiver;

c) a grip mounted to the lower receiver;

d) a trigger system housed inside the lower receiver;

e) a safety mounted on the lower receiver, the safety operatively connected to the trigger system, wherein the trigger system comprises:

(i) a trigger projecting downwardly from the lower receiver, (ii) a base plate attached to the trigger, the base plate housed inside the lower receiver, the base plate having a back end, and a front end opposite the back end, the trigger and base plate configured such that when the trigger is pulled, the base plate teeters in which the back end of the base plate rises and the front end of the base plate lowers, (iii) a spring-loaded hammer operatively connected to the base plate, the spring-loaded hammer having a cocked configuration and a released configuration, wherein the spring-loaded hammer is configured to enter the released configuration when the trigger is pulled, f) wherein the safety comprises a partial cylinder defining a longitudinal axis, comprising:

(i) a first flat end, (ii) a second flat end opposite the first flat end, (iii) a curved face therebetween, and (iv) a flat face adjacent to the curved face and in between the first flat end and the second flat end, wherein the longitudinal axis is parallel to the flat face and perpendicular to the first flat end and the second flat end, (v) wherein the partial cylinder is configured to rotate about the longitudinal axis into a safety-on configuration in which the curved face is directed towards the back end of the base plate blocking the back end of the base plate from releasing the hammer, and a safety-off configuration in which the flat face is directed towards the back end of the base plate defining a gap between the back end of the base plate and the partial cylinder, wherein the gap is sufficiently large that the back end of the base plate can rise enough to release the hammer; and g) a firearm locking system mounted in the lower receiver behind the trigger system, the firearm locking system comprising a trigger lock having a bar insertable into the gap to block the back end of the base plate of the trigger system from rising, the trigger lock having an unlocked configuration in which the bar is outside the gap, and a locked configuration in which the bar is within the gap.

2. The firearm of claim 1, wherein the trigger lock is configured to be actuated remotely.

3. The firearm of claim 2, further comprising a tamper-resistant system to prevent unauthorized users from attempting to disable the firearm locking system, the tamper-resistant system comprising a receiver lock connected to the upper receiver, wherein actuation of the trigger lock causes the receiver lock to lock the upper receiver to the lower receiver.

4. The firearm of claim 3, further comprising a first pin mounted on an actuator to move the pin linearly, and a first spring biased against the trigger lock to bias the trigger lock forward, wherein the first pin is attached to the trigger lock, and the actuator is connected to the grip, wherein when the grip is removed, the first pin is released from the trigger lock, and the first spring advances the trigger lock forward.

5. The firearm of claim 4, further comprising a second pin adjacent to the trigger lock, wherein the second pin is housed in a recess with a second spring, wherein the trigger lock has a jammed configuration in which the second pin is positioned in the linear path of the trigger lock to prevent the trigger lock from returning to the unlocked configuration.

6. The firearm of claim 4, wherein the trigger lock comprises a rod, wherein the first pin is attached to the rod and the rod is partially housed in a channel, wherein the first spring biases the trigger lock in the forward direction, such that when the pin is detached from the rod, the first spring pushes the rod fully into the channel.

7. The firearm of claim 6, further comprising reinforcement plates bilaterally arranged about to the trigger lock to prevent tampering by drilling or cutting through the lower receiver.

8. The firearm of claim 7, wherein the receiver lock comprises a lower portion configured to reside in between mounting cylinders of the safety to prevent lateral movement of the safety.

* * * * *